US009818365B2

(12) United States Patent
Xu et al.

(10) Patent No.: US 9,818,365 B2
(45) Date of Patent: Nov. 14, 2017

(54) METHOD AND DEVICE FOR ADJUSTING A DISPLAY PICTURE

(71) Applicant: BOE Technology Group Co., Ltd., Beijing (CN)

(72) Inventors: Chao Xu, Beijing (CN); Chunfang Zhang, Beijing (CN); Yan Wei, Beijing (CN); Heecheol Kim, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 503 days.

(21) Appl. No.: 14/051,738

(22) Filed: Oct. 11, 2013

(65) Prior Publication Data

US 2014/0104322 A1 Apr. 17, 2014

(30) Foreign Application Priority Data

Oct. 11, 2012 (CN) ..... 2012 1 0384458

(51) Int. Cl.
*G09G 5/10* (2006.01)
*G09G 3/36* (2006.01)

(52) U.S. Cl.
CPC ..... *G09G 3/3696* (2013.01); *G09G 3/3611* (2013.01); *G09G 2310/08* (2013.01); *G09G 2320/0242* (2013.01); *G09G 2370/08* (2013.01); *G09G 2370/14* (2013.01)

(58) Field of Classification Search
CPC ..... G09G 2310/08; G09G 2320/0242; G09G 2370/08; G09G 2370/14; G09G 3/3611; G09G 3/3696
See application file for complete search history.

(56) References Cited

U.S. PATENT DOCUMENTS

2009/0085845 A1* 4/2009 Cho ..... G09G 3/2014 345/83
2010/0045583 A1 2/2010 Park et al.
2012/0062572 A1* 3/2012 Mignard ..... G02B 26/001 345/501

(Continued)

FOREIGN PATENT DOCUMENTS

CN 101320552 A 12/2008

OTHER PUBLICATIONS

First office action and search report from Chinese Patent Office for priority application 201210384458.2 dated Mar. 5, 2014.

(Continued)

*Primary Examiner* — Insa Sadio
(74) *Attorney, Agent, or Firm* — Haug Partners LLP

(57) ABSTRACT

The present invention discloses a method and a device for adjusting a display picture to solve a problem in the prior art that when Greenish phenomenon of a liquid crystal display screen is alleviated, aperture ratio of the display panel is decreased so that power consumption of the screen is increased. The method for adjusting the display picture includes the steps of: receiving a first clock signal for controlling a data line voltage signal for a pixel of the first color in the display picture and receiving a second clock signal for controlling data line voltage signals for pixels of the other colors; and making a pulse width at high level of the first clock signal smaller than a high level pulse width of the second clock signal, wherein the first color is closer to green than other colors.

24 Claims, 6 Drawing Sheets

(56) References Cited

U.S. PATENT DOCUMENTS

2012/0098808 A1* 4/2012 Jang ..... G09G 3/3696
345/209
2012/0249422 A1* 10/2012 Tse ..... G06F 3/0304
345/158

OTHER PUBLICATIONS

Second office action from Chinese Patent Office for priority application 201210384458.2 dated Sep. 3, 2014.

* cited by examiner

METHOD AND DEVICE FOR ADJUSTING A DISPLAY PICTURE

FIELD OF THE INVENTION

The present invention relates to the field of display technology, and particularly to a method and a device for adjusting a display picture.

BACKGROUND OF THE INVENTION

With the progressive development of the liquid crystal display technology and the price advantage of the liquid crystal display screen, the liquid crystal display screen is used as a display screen of various electronic apparatus in our lives or a decorative electronic display device, which has gradually become a trend of the liquid crystal display screen. The liquid crystal display screen in the prior art has been widely used in various kinds of electric appliances, e.g. a liquid crystal display television, a mobile telephone and so on.

When a specific display picture is displayed on the liquid crystal display screen, a greenish phenomenon (i.e., Greenish (green flickering) phenomenon) may occur. FIG. 1 illustrates a timing diagram of voltage signals applied to the data lines of red, green and blue pixels in the prior art. As can be seen from FIG. 1, the timing graphics of voltage signals applied to data line for pixels of the three colors are exactly the same, that is, the pulse widths at high level of voltage signals applied to data lines for pixels of the three colors are exactly the same. Due to characteristics of the green pixel itself and the special sensing characteristics to green of the human eyes, the human eyes are more sensitive to green light than red light and blue light. When an all white picture is displayed on the display screen, the flicker phenomenon is easy to occur, especially at the instant when the all white picture is switched to a all black picture, the Greenish phenomenon is easier to occur, and when the flicker phenomenon and the Greenish phenomenon occur, green light perceived by the human eyes are more intense.

In the prior art, as shown in FIG. 1, in the case that pulse widths at high level of data line voltage signals applied to data lines for red, green and blue pixels in the display panel are exactly the same, because of the above reasons, Greenish phenomenon will inevitably occur in the picture seen with the human eye. FIG. 2 illustrates a macro-effect diagram locally showing the picture corresponding to the timing diagram of data line voltage signals for pixels of the three colors shown in FIG. 1. Density of black dots and corresponding numbers in FIG. 2 denote the severity of Greenish phenomenon, wherein, the larger the density of black dots is and the bigger the corresponding number is, the higher the severity of Greenish phenomenon is. FIG. 3 illustrates a schematic view of the circuit arrangement applying timing change to data line voltage signals for pixels of the above three colors in the prior art. FIG. 4 illustrates a timing diagram of data line voltage signals applied to pixels of the above three colors under a single clock signal control in the circuit illustrated in FIG. 3.

From the point of structure of the display panel, reasons for Greenish phenomenon inevitably occurring further include: as for a general display picture, during performing wiring on a printed circuit board, the common voltage Vcom wiring may not be centered, which will induce an instable Vcom and result in the fact that changes in the Vcom brought by data line voltage signals cannot be cancelled out, thus brightness of the green pixel is increased, which will in turn result in occurrence of Greenish phenomenon.

In the prior art, methods for solving Greenish phenomenon include: increasing area of Vcom wiring to decrease resistance in the circuit and then enable the Vcom to be stable; or, employing a Matrix Vcom (matrix common voltage) arrangement to change a former pattern, in which a common electrode at the leftmost end is used to connect a plurality of parallel Vcom lines, into a grid pattern, so as to effectively stabilize the Vcom. In the two methods described above, Greenish phenomenon is alleviated by changing the wiring on the printed circuit board, however, occurrence of Greenish phenomenon can not be solved from the fundamental reasons, and moreover, with the technical solutions in the above two methods, aperture ratio of the liquid crystal display screen could be decreased, causing increased power consumption of the screen.

SUMMARY OF THE INVENTION

The present invention provides a method and a device for adjusting a display picture to solve the problem in the prior art that when Greenish phenomenon of a liquid crystal display screen is alleviated, aperture ratio of the display panel is decreased so that power consumption of the screen is increased.

According to a first aspect of the present invention, there is provided a method for adjusting a display picture, including: receiving a first clock signal for controlling a data line voltage signal for a pixel of the first color in the display picture and receiving a second clock signal for controlling data line voltage signals for pixels of the other colors; and making a pulse width at high level of the first clock signal smaller than that of the second clock signal, wherein, the first color is closer to green than the other colors.

Preferably, an optical wavelength of the first color is within a range of 450 nm to 600 nm, more preferably, the optical wavelength of the first color is within a range of 500 nm to 550 nm.

Preferably, the pixel of the first color is a green pixel, and the pixels of the other pixels include a red pixel and a blue pixel.

Preferably, the step of making the pulse width at high level of the first clock signal smaller than that of the second clock signal includes: making the pulse width at high level of the first clock signal be ⅔ to ⅘ of that of the second clock signal.

Preferably, the method further includes a step of making a high level voltage of the first clock signal equal to that of the second clock signal.

Preferably, a period length of the first clock signal is equal to that of the second clock signal.

Preferably, after the step of making the pulse width at high level of the first clock signal smaller than that of the second clock signal, the method further includes steps of: applying a data line voltage signal for the red pixel to the data line for the red pixel to control display of the red pixel on the display panel, applying a data line voltage signal for the green pixel to the data line for the green pixel to control display of the green pixel on the display panel, and applying a data line voltage signal for the blue pixel to the data line for the blue pixel to control display of the blue pixel on the display panel.

According to another aspect of the present invention, there is provided a device for adjusting a display picture, including: a receiving unit configured to receive a first clock signal for controlling a data line voltage signal for a pixel of the first color in the display picture and receive a second clock signal for controlling data line voltage signals for pixels of the other colors; and a processing unit configured to make a pulse width at high level of the first clock signal smaller than that of the second clock signal; wherein the first color is closer to green than the other colors.

Preferably, an optical wavelength of the first color is within a range of 450 nm to 600 nm. More preferably, the optical wavelength of the first color is within a range of 500 nm to 550 nm.

Preferably, the pixel of the first color is a green pixel, and the pixels of the other pixels include a red pixel and a blue pixel.

Preferably, the processing unit is configured to make the pulse width at high level of the first clock signal be ⅔ to ⅘ of that of the second clock signal.

Preferably, the processing unit is further configured to make a high level voltage of the first clock signal equal to that of the second clock signal.

Preferably, the processing unit is further configured to make a period length of the first clock signal equal to that of the second clock signal.

Preferably, the processing unit is further configured to apply a data line voltage signal for the red pixel to the data line for the red pixel to control display of the red pixel on the display panel, apply a data line voltage signal for the green pixel to the data line for the green pixel to control display of the green pixel on the display panel, and apply a data line voltage signal for the blue pixel to the data line for the blue pixel to control display of the blue pixel on the display panel.

In the above technical solutions, by shortening a time period during which a data line for the green pixel is maintained at a high level, the pixel voltage on the green pixel is lower than those on the red and blue pixels, so as to cancel out the sensitivity of the human eyes to green so that the same color display effect can be visually achieved for the three colors (green, red and blue); simply by making some control to the circuit of the liquid crystal display screen in the prior art, Greenish phenomenon of the liquid crystal display screen can be efficiently alleviated, without influencing the circuit arrangement for controlling the liquid crystal display panel and the aperture ratio of the display panel, therefore the problem in which the power consumption of the screen is increased while Greenish phenomenon is alleviated is efficiently solved.

DETAILED DESCRIPTION OF THE EMBODIMENTS

One object of the present invention is to solve the problem in the prior art that the power consumption of the liquid crystal display screen is increased while alleviating Greenish phenomenon of the screen. An embodiment of the present invention provides a method for adjusting a display picture, including steps of: receiving a first clock signal for controlling a data line voltage signal for a pixel of the first color in the display picture and receiving a second clock signal for controlling data line voltage signals for pixels of the other colors; and making a pulse width at high level of the first clock signal smaller than that of the second clock signal, wherein, the first color is closer to green than the other colors.

By using the above technical solutions, through shortening a time period during which a data line for the pixel of first color is maintained at a high level, the pixel voltage on the pixel of first color is lower than those on the pixels of other color, so as to cancel out the sensitivity of the human eyes to the first color so that the same color display effect can be visually achieved for the first color and the other colors; simply by making some control to the circuit of the liquid crystal display screen in the prior art, Greenish phenomenon of the liquid crystal display screen can be efficiently alleviated, without influencing the circuit arrangement for controlling the liquid crystal display panel and the aperture ratio of the display panel, therefore efficiently solving the problem that the power consumption of the screen while alleviating Greenish phenomenon.

Embodiment in above solution may applicable for adjusting a display picture for various of pixel types and various pixel colors, for example, the first color may be closer to green, and the other colors may include a various of colors, not limited to red and blue, and may include yellow or the like. Furthermore, there is no limitation to the types of colors, the invention may includes three colors, four colors or six colors, and in any case, a same effect may be obtained. For convenience, description will be described by taking three colors of green, red and blue as an example.

Hereinafter, preferred embodiments of the present invention will be described in detail in conjunction to the drawings. In this embodiment, description will be described taking the following as an example, that is, green is used the first color and red and blue are used as the other colors.

Figure 5:
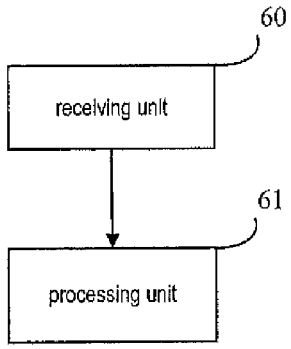
FIG. 5 illustrates a structural diagram of a device for adjusting a display picture according to an embodiment of the present invention.

Referring to FIG. 5, in an embodiment of the present invention, a device for adjusting a display picture includes a receiving unit 60 and a processing unit 61. The receiving unit 60 is configured to receive a first clock signal for controlling a data line voltage signal for a green pixel, and to receive a second clock signal for controlling data line voltage signals for red and blue pixels. The processing unit 61 is configured to make the pulse width at high level of the first clock signal smaller than that of the second clock signal.

Figure 6:
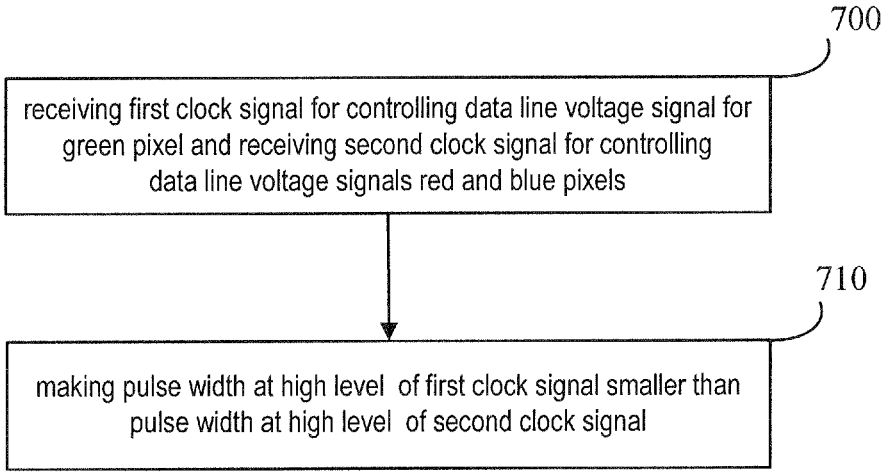
FIG. 6 illustrates a flowchart of a method for adjusting a display picture according to embodiments of the present invention.

Based on the above technical solution and referring to FIG. 6, the detailed process for adjusting a display picture in the embodiment is as follows.

Step 700: receiving a first clock signal for controlling a data line voltage signal for a green pixel and receiving a second clock signal for controlling data line voltage signals for red and blue pixels.

During fabrication of the liquid crystal display screen, a PCB circuit is connected to a display picture control device, and the display picture control device receives a first clock signal and a second clock signal sent from the PCB circuit. Specifically, the first clock signal is used to control the data line voltage signal for the green pixel, and the second clock signal is used to control the data line voltage signals for the red and blue pixels. Also, a period length of the first clock signal is the same as that of the second clock signal, and the starting position of a high level signal of the first clock signal is absolutely the same as that of the second clock signal. The high level voltage of the first clock signal is the same as that of the second clock signal.

Step 710: making the pulse width at high level of the first clock signal smaller than that of the second clock signal.

In the prior art, a single clock signal is used to control the data line voltage signals for pixels of the three colors and it is assumed that the pulse width at high level of the clock signal used in the prior artist. In the embodiment of the present invention, two clock signals sent from the PCB circuit (i.e., the first and second clock signals) are received. It is assumed that the pulse width at high level of the first clock signal is t1 and the pulse width at high level of the second clock signal is t2, wherein $t1 \leq t2$, preferably, $t1=(2/3 \sim 4/5)\ t2$, and $t1=t$.

The first clock signal and the second clock signal control the data line voltage signals for pixels of different colors, respectively. Wherein, the pulse widths at high level of the respective clock signals correspond to the pulse widths at high level of the data line voltage signals for pixels of corresponding colors. In the embodiment of the present invention, $t1=(2/3 \sim 4/5)\ t2$, that is, the pulse width at high level of the data line voltage signal for the green pixel is 2/3~4/5 of that of the red or blue pixel. By using above preferred technical solution, it only needs to change the pulse width at high level of the clock signal for controlling the data line voltage signal for the green pixel, without changing high and low level voltages of the clock signals for controlling the data line voltage signals for pixels of the above three colors. That is, Greenish phenomenon may be alleviated with minimum circuit modification.

It should be understood that, in case of $t1<2/3*t2$, since there is a great difference between the pulse widths at high level of the data line voltage signals for the red and blue pixels and that for the green pixel, when the data line voltage signals for pixels of the three colors are input into the display panel, they are combined by the display panel, and when a picture is displayed on the screen, it is likely to occur a phenomenon that the color of picture presented on the screen is inclined to be blue or red.

It also should be understood that, in case of $t1>4/5*t2$, since there is a little difference between the pulse widths at high level of the data line voltage signals for the red and blue pixels and that for the green pixel, when the data line voltage signals for pixels of the three colors are input into the display panel, they are combined by the display panel, and when a picture is displayed on the screen, it is likely to occur a phenomenon that the color of picture presented on the screen is inclined to be green, that is, Greenish phenomenon still exists to some extent now.

When $t1<2/3*t2$ and $t1>4/5*t2$, the display panel may be applied to some occasions where there are special requirements for display pictures presented on the display screen, for example, a occasion in which it is necessary for a display picture provided in the exhibition room to be inclined to a certain color to reach a certain exhibition effect.

Figure 7:
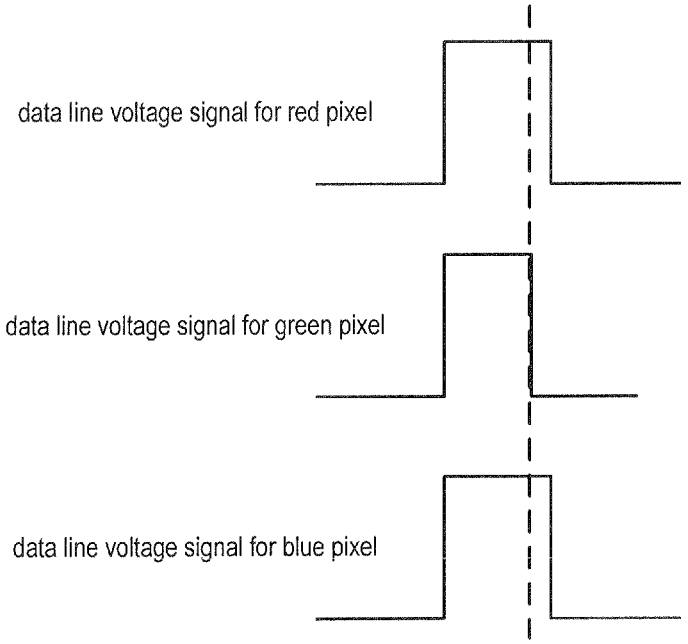
FIG. 7 illustrates a timing diagram of the adjusted data line voltage signals for pixels of three colors according to an embodiment of the present invention.

FIG. 7 illustrates a timing diagram of data line voltage signals for pixels of three colors after the circuit arrangement is adjusted in an embodiment of the present invention, the timing diagram in FIG. 7 represents variations of the data line voltage signal for pixels of the three colors in an ideal state. That is, in the ideal state, all the data line voltage signals for pixels of the three colors are standard square-wave signal pulses.

Figure 8:
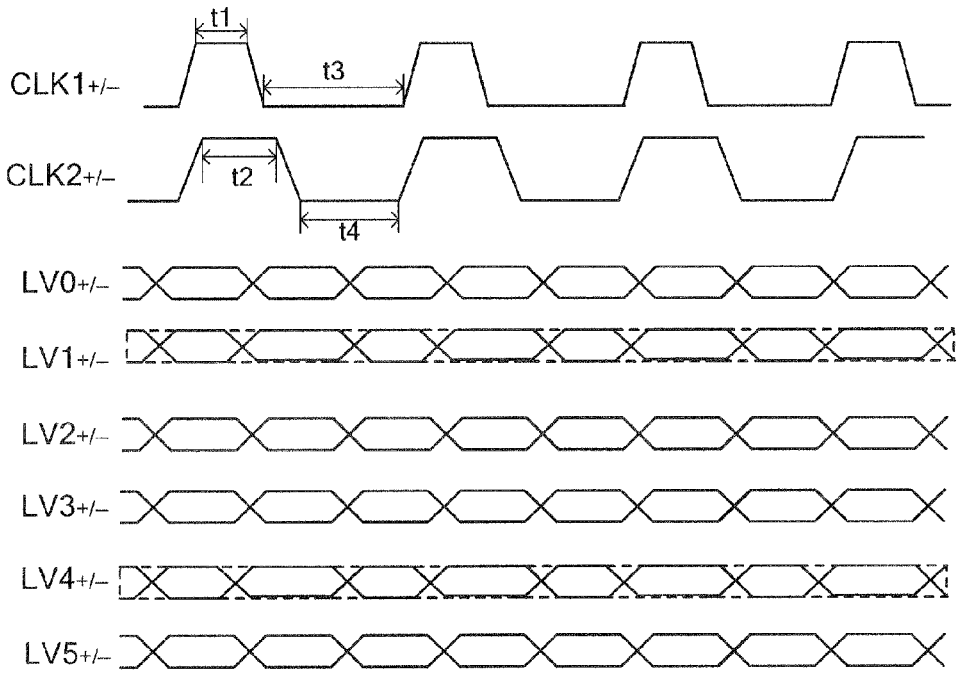
FIG. 8 illustrates a timing diagram of data line voltage signals applied to pixels of three colors controlled by different clock signals according to an embodiment of the present invention.

As shown in FIG. 8, in an actual circuit, the above so-called standard square-wave signal pulse is an approximate square-wave signal pulse including rising and falling edges. In FIG. 8, the data line voltage signals for pixels of the three colors are controlled by different clock signals. Specifically, the first clock signal CLK1 controls the data line voltage signal for the green pixel, and the second clock signal CLK2 controls the data line voltage signals for the red and blue pixels. LV0 and LV3 denote the data line voltage signals for red pixels; LV1 and LV4 denote the data line voltage signals for green pixels; and LV2 and LV5 denote the data line voltage signals for blue pixels.

As can be seen from FIG. 8, the first clock signal CLK1 controls the data line voltage signals for green pixels LV1 and LV4, and the second clock signal CLK2 controls the data line voltage signals for red pixels LV0 and LV3, as well as the data line voltage signals for blue pixels LV2 and LV5.

In an embodiment of the present invention, the pulse width at high level t1 of the first clock signal CLK1 is smaller than the pulse width at high level t2 of the second clock signal CLK2; the pulse width at low level t3 of the first clock signal CLK1 is larger than the pulse width at low level t4 of the second clock signal CLK2; and the period length of the first clock signal CLK1 is equal to that of the second clock signal CLK2, i.e., $t1+t3=t2+t4$. In each period, the starting position of the high level of the first clock signal is the same as that of the second clock signal.

As shown in FIG. 8, under control of the first clock signal CLK1, the pulse widths at high level of the data line voltage signals for green pixels LV1 and LV4 are smaller than both the pulse widths at high level of the data line voltage signals for red pixels LV0 and LV3, and the pulse widths at high level of the data line voltage signals for blue pixels LV2 and LV5. Moreover, as can be seen from the relationship between the first clock signal CLK1 and the second clock signal CLK2, the pulse widths at low level of the data line voltage signals for green pixels LV1 and LV4 are larger than both the pulse widths at low level of the data line voltage signals for red pixels and the pulse widths at low level of the data line voltage signals for blue pixels LV2 and LV5. The data line voltage signals for green pixels LV1 and LV4, the data line voltage signals for red pixels LV0 and LV3, and the data line voltage signals for blue pixels LV2 and LV5 have the same period length.

In the embodiment of the present invention, when displaying pictures on the display panel, display of red pixels on the display panel is controlled by applying the data line voltage signals for red pixels LV0 and LV3 to the data lines for red pixels, display of green pixels on the display panel is controlled by applying the data line voltage signals for green pixels LV1 and LV4 to the data lines for green pixels, and display of blue pixels on the display panel is controlled by applying the data line voltage signals for blue pixels LV2 and LV5 to the data lines for blue pixels.

In the technical solution according to the present invention, a minor alteration is made to the circuit arrangement, and the data line voltage signal for pixel of a certain color can be effectively controlled to effectively alleviate Greenish phenomenon by programming during pre-processing so as to only change the pulse widths at high and low level of a clock signal, but not to change the total duration of one cycle of the clock signal.

Figure 9:
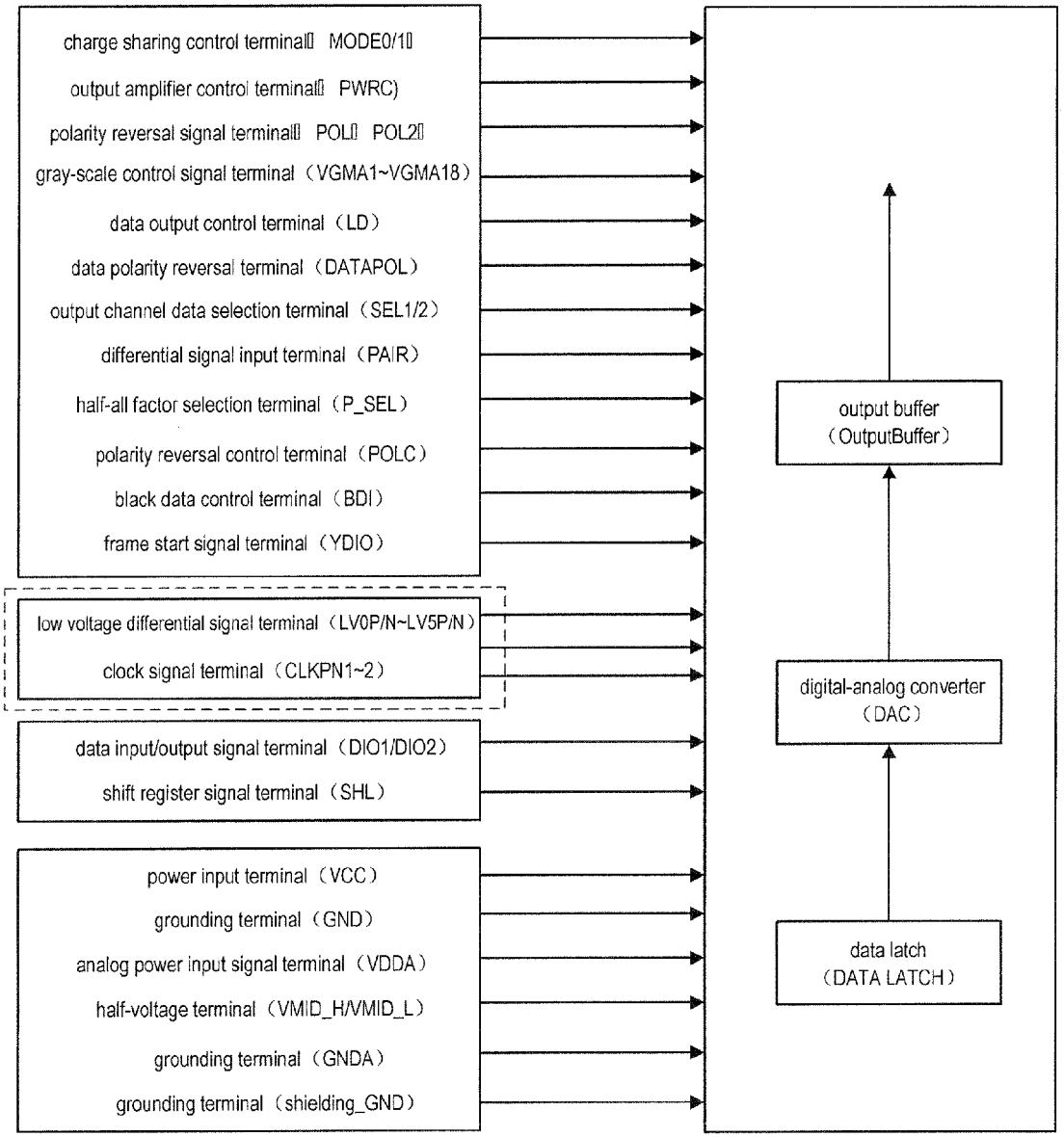
FIG. 9 illustrates a schematic view of a circuit arrangement applying timing change to data line voltage signals for pixels of three colors according to an embodiment of the present invention.

FIG. 9 illustrates a schematic view of a circuit arrangement according to an embodiment of the present invention, wherein MODE0/1 denotes a charge sharing control terminal; PWRC denotes an output amplifier control terminal; POL and POL2 denote polarity reversal signal terminals; VGMA1~VGMA18 denote gray-scale control signal terminals; LD denotes a data output control terminal; DATAPOL denotes a data polarity reversal terminal; SEL1/2 denotes an output channel data selection terminal; PAIR denotes a differential signal input terminal; P_SEL denotes a half-all factor selection terminal; POLC denotes a polarity reversal control terminal; BDI denotes a black data control terminal; YDIO denotes a frame start signal terminal; LV0P/N~LV5P/N denote low voltage differential signal terminals; CLKPN1~2 denote clock signal terminals; DIO1/DIO2 denotes a data input/output signal terminal; SHL denotes a shift register signal terminal; VCC denotes a power input terminal; GND denotes a grounding terminal; VDDA denotes an analog power input signal terminal; VMID_H/VMID_L denotes a half-voltage terminal; GNDA denotes a grounding terminal; shielding_GND denotes a grounding terminal; OutputBuffer denotes an output buffer; DAC denotes a digital-analog converter; and DATA LATCH denotes a data latch. Wherein, the OutputBuffer, DAC and DATA LATCH are devices inside the display panel.

As can be seen from FIG. 9, as compared with the prior art in which a single clock signal is used to control the data line voltage signals for pixels of different colors, the improvement in the embodiment of the invention is to use two different clock signals, i.e. the first clock signal and the second clock signal, to control the data line voltage signals for pixels of different colors, wherein the first clock signal is exactly the same as the single clock signal in the prior art, and the pulse width at high level of the first clock signal is smaller than that of the second clock signal.

Figure 1:
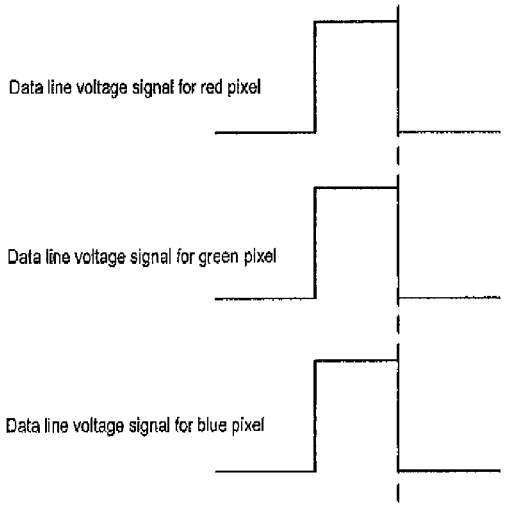
FIG. 1 Prior Art
FIG. 1 illustrates a timing diagram of data line voltage signals applied to red, green and blue pixels in the prior art.
Figure 2:
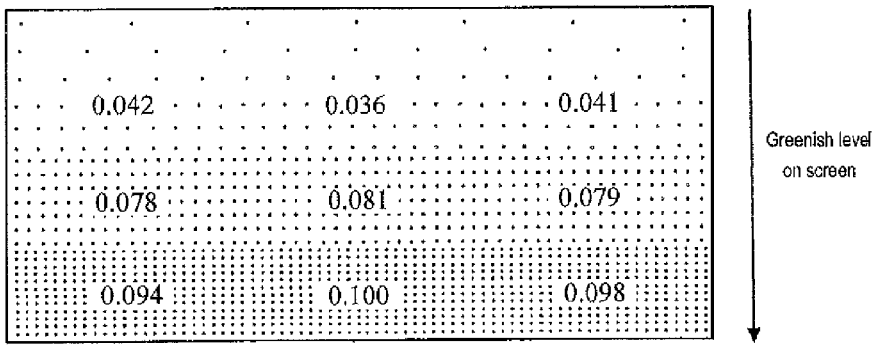
FIG. 2 Prior Art
FIG. 2 illustrates a macro-effect diagram locally showing the picture corresponding to the timing diagram of data line voltage signals for pixels of the three colors shown in FIG. 1.
Figure 3:
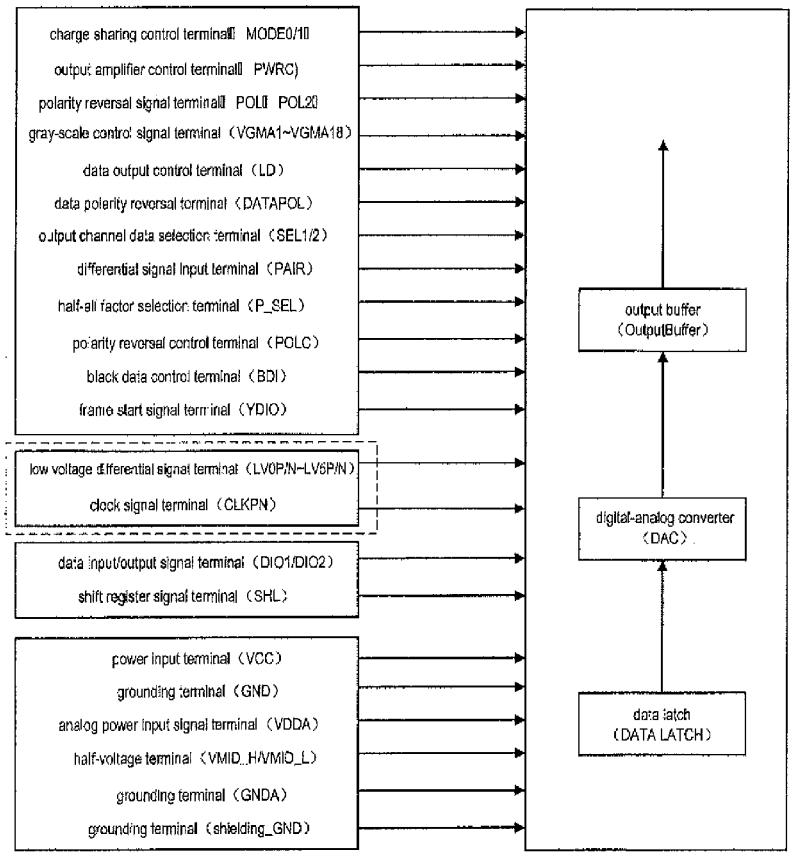
FIG. 3 Prior Art
FIG. 3 illustrates a schematic view of a circuit arrangement applying timing change to data line voltage signals for pixels of the three colors in the prior art.
Figure 4:
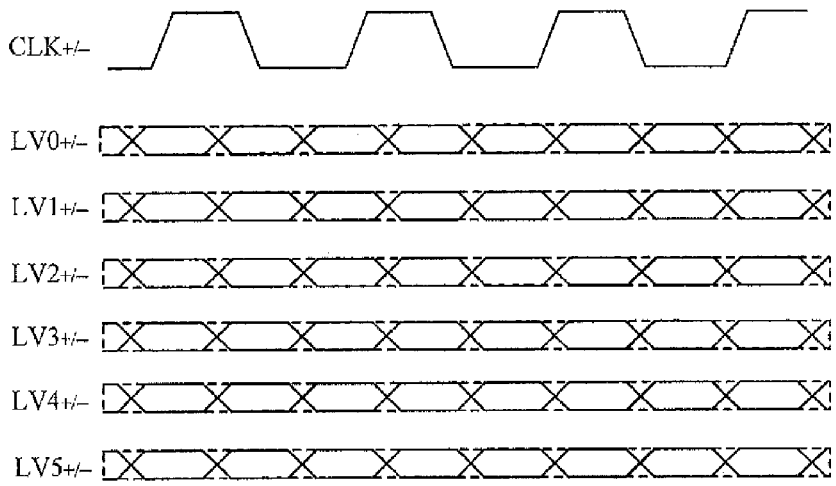
FIG. 4 Prior Art
FIG. 4 illustrates a timing diagram of data line voltage signals applied to pixels of the three colors controlled by a single clock signal in the circuit illustrated in FIG. 3.

Comparing FIGS. 3 and 9, in the circuit arrangement according to the embodiment of the present invention, only a minor alternation is made to the pin configuration of the control chip in hardware, specifically to add a clock control pin or to change the function of a spare pin on the control chip in the prior art, so that the control chip includes two clock signal pins (CLKPN1~2). The control chip on the printed circuit board is set and the function of the added pin is further defined in such a manner that the pulse width at high level of the first clock signal outputted from the pin reaches a preset value. The data line voltage signals for pixels of various colors are controlled by the first and second clock signals respectively, such that the pulse width at high level of the data line voltage signal for the green pixel is smaller than those of both the red pixel and the blue pixel. The data line voltage signals for pixels of various colors adjusted in the above manner are transmitted to inside of the display panel respectively, and are combined by the display panel to present on the display screen a normal picture in which various colors are displayed relatively uniformly.

It can be deduced from the above contents, the inventive concept of the present invention is as follows: since light of different colors (for example, red, green and blue light) has different spectrum, and sensitivity of the human eyes to red, green and blue is different (that is, sensitivity of the human eyes to green, red, and blue light is reduced successively), as for viewing effects of the human eyes, light of different colors has different light transmittance on the display device, wherein light transmittance of green, red and blue light is reduced successively (for example, green light looks brighter, blue light looks dimmer and brightness of red light is between those of green and red light). In the embodiment of the present invention, since lightening time of pixel of each color is controlled by the pulse width at high level of the corresponding data line voltage signal, by making the pulse width at high level of the data line voltage signal for pixel having a larger brightness smaller than that for pixel having a lower brightness, the lightening time of pixel of the color, to which the human eyes are more sensitive due to its high light transmittance, can be accordingly shortened, so as to alleviate the dominant role of the green pixel on the visual observations, thereby avoiding occurrence of Greenish phenomenon from fundamental reasons.

In view of above, the method according to the embodiments of the present invention includes the steps of: receiving a first clock signal for controlling a data line voltage signal for a green pixel and receiving a second clock signal for controlling data line voltage signals for a red and blue pixels; and making the pulse width at high level of the first clock signal smaller than the pulse width at high level of the second clock signal. In the above technical solution, by shortening the time period during which the data line for the green pixel is maintained at a high level so that the pixel voltage on the green pixel is smaller than those on the red and blue pixels, the sensitivity of the human eye to green is cancelled out, thereby visually achieving the same display effect for the three colors. In the above technical solution, the control circuit of the liquid crystal display panel is controlled to effectively alleviate Greenish phenomenon of the liquid crystal display screen without influencing the circuit arrangement of the control circuit of the liquid crystal display panel and the aperture ratio of the display panel. As a result, the problem of increasing the power consumption of the screen while alleviating Greenish phenomenon can be avoided effectively.

Obviously, the person skilled in the art may make various modifications and variations to the present invention without departing from the spirit and scope of the present invention. Thus, if these modifications and variations to the present invention fall into the scope of claims of the present invention and equivalents thereof, it is intended that the present invention includes these modifications and variations.

What is claimed is:

1. A method for adjusting a liquid crystal display picture, comprising steps of:

receiving a first clock signal for controlling a data line voltage signal for a pixel of a first color in the liquid crystal display picture and receiving a second clock signal for controlling data line voltage signals for pixels of other colors; and making a pulse width at high level of the first clock signal smaller than that of the second clock signal, so that a greenish color of the liquid crystal display picture is reduced, wherein, the first color is closer to green than the other colors.

2. The method according to claim 1, wherein optical wavelength of the first color is within a range of 450 nm to 600 nm.

3. The method according to claim 2, wherein the optical wavelength of the first color is within a range of 500 nm to 550 nm.

4. The method according to claim 3, wherein the pixel of the first color is a green pixel, and the pixels of the other pixels include a red pixel and a blue pixel.

5. The method according to claim 4, wherein after the step of making the pulse width at high level of the first clock signal smaller than that of the second clock signal, the method further includes steps of:

applying a data line voltage signal for the red pixel to the data line for the red pixel to control display of the red pixel on the display panel, applying a data line voltage signal for the green pixel to the data line for the green pixel to control display of the green pixel on the display panel, and applying a data line voltage signal for the blue pixel to the data line for the blue pixel to control display of the blue pixel on the display panel.

6. The method according to claim 2, wherein the pixel of the first color is a green pixel, and the pixels of the other pixels include a red pixel and a blue pixel.

7. The method according to claim 6, wherein after the step of making the pulse width at high level of the first clock signal smaller than that of the second clock signal, the method further includes steps of:

applying a data line voltage signal for the red pixel to the data line for the red pixel to control display of the red pixel on the display panel, applying a data line voltage signal for the green pixel to the data line for the green pixel to control display of the green pixel on the display panel, and applying a data line voltage signal for the blue pixel to the data line for the blue pixel to control display of the blue pixel on the display panel.

8. The method according to claim 1, wherein the pixel of the first color is a green pixel, and the pixels of the other pixels include a red pixel and a blue pixel.

9. The method according to claim 8, wherein after the step of making the pulse width at high level of the first clock signal smaller than that of the second clock signal, the method further includes steps of:

applying a data line voltage signal for the red pixel to the data line for the red pixel to control display of the red pixel on the display panel, applying a data line voltage signal for the green pixel to the data line for the green pixel to control display of the green pixel on the display panel, and applying a data line voltage signal for the blue pixel to the data line for the blue pixel to control display of the blue pixel on the display panel.

10. The method according to claim 1, wherein the step of making the high level pulse width of the first clock signal smaller than that of the second clock signal includes:

making the pulse width at high level of the first clock signal be ⅔ to ⅘ of that of the second clock signal.

11. The method according to claim 1, further including step of:

making a high level voltage of the first clock signal equal to that of the second clock signal.

12. The method according to claim 1, wherein a period length of the first clock signal is equal to that of the second clock signal.

13. A device for adjusting a liquid crystal display picture, which comprises a control chip, wherein the control chip comprises:

a first clock signal pin configured to receive a first clock signal for controlling a data line voltage signal for a pixel of a first color in the liquid crystal display picture; and a second clock signal pin configured to receive a second clock signal for controlling data line voltage signals for pixels of other colors, wherein the first color is closer to green than the other colors;

wherein the control chip is configured to make a pulse width at high level of the first clock signal smaller than that of the second clock signal, so that a greenish color of the liquid crystal display picture is reduced.

14. The device according to claim 13, wherein optical wavelength of the first color is within a range of 450 nm to 600 nm.

15. The device according to claim 14, wherein the optical wavelength of the first color is within a range of 500 nm to 550 nm.

16. The device according to claim 15, wherein the pixel of the first color is a green pixel, and the pixels of the other pixels include a red pixel and a blue pixel.

17. The device according to claim 16, wherein the processing unit is further configured to:

applying a data line voltage signal for the red pixel to the data line for the red pixel to control display of the red pixel on the display panel, applying a data line voltage signal for the green pixel to the data line for the green pixel to control display of the green pixel on the display panel, and applying a data line voltage signal for the blue pixel to the data line for the blue pixel to control display of the blue pixel on the display panel.

18. The device according to claim 14, wherein the pixel of the first color is a green pixel, and the pixels of the other pixels include a red pixel and a blue pixel.

19. The device according to claim 18, wherein the processing unit is further configured to:

applying a data line voltage signal for the red pixel to the data line for the red pixel to control display of the red pixel on the display panel, applying a data line voltage signal for the green pixel to the data line for the green pixel to control display of the green pixel on the display panel, and applying a data line voltage signal for the blue pixel to the data line for the blue pixel to control display of the blue pixel on the display panel.

20. The device according to claim 13, wherein the pixel of the first color is a green pixel, and the pixels of the other pixels include a red pixel and a blue pixel.

21. The device according to claim 20, wherein the processing unit is further configured to:

applying a data line voltage signal for the red pixel to the data line for the red pixel to control display of the red pixel on the display panel, applying a data line voltage signal for the green pixel to the data line for the green pixel to control display of the green pixel on the display panel, and applying a data line voltage signal for the blue pixel to the data line for the blue pixel to control display of the blue pixel on the display panel.

22. The device according to claim 13, wherein the processing unit is configured to:

make the pulse width at high level of the first clock signal be ⅔ to ⅘ of that of the second clock signal.

23. The device according to claim 13, wherein the processing unit is further configured to:

make a high level voltage of the first clock signal equal to that of the second clock signal.

24. The device according to claim 13, wherein the processing unit is further configured to:

make a period length of the first clock signal equal to that of the second clock signal.

* * * * *